US006981695B1

(12) United States Patent
Hedlund et al.

(10) Patent No.: US 6,981,695 B1
(45) Date of Patent: Jan. 3, 2006

(54) ALL TERRAIN VEHICLE WITH MULTIPLE WINCHES

(75) Inventors: Dean Hedlund, Roseau, MN (US); David Foss, Greenbush, MN (US); Ryan Sorenson, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/684,693

(22) Filed: Oct. 14, 2003

(51) Int. Cl.
*B66D 1/00* (2006.01)

(52) U.S. Cl. ..... 254/323; 254/328

(58) Field of Classification Search ..... 254/323, 254/328

See application file for complete search history.

(56) References Cited

U.S. PATENT DOCUMENTS

| | | | | |
|---|---|---|---|---|
| 1,166,575 | A * | 1/1916 | Botts | 254/328 |
| 2,606,745 | A | 8/1952 | Ball et al. | |
| 3,613,919 | A | 10/1971 | Ceepo et al. | |
| 4,256,344 | A * | 3/1981 | Hatcher | 299/39.4 |
| 4,331,323 | A | 5/1982 | Sekimori et al. | |
| 4,555,092 | A | 11/1985 | Overholt | |
| 4,578,014 | A | 3/1986 | Colet | |
| 4,950,010 | A | 8/1990 | Denny | |
| 5,072,962 | A * | 12/1991 | Webb | 280/414.1 |
| 5,120,185 | A * | 6/1992 | Mummert | 414/563 |
| 5,207,552 | A * | 5/1993 | Mummert | 414/563 |
| 5,387,071 | A * | 2/1995 | Pinkston | 414/563 |
| 6,126,378 | A * | 10/2000 | Landoll et al. | 414/494 |
| 6,334,269 | B1 | 1/2002 | Dilks | |
| 6,623,205 | B1 * | 9/2003 | Ramirez | 404/6 |

* cited by examiner

*Primary Examiner*—Emmanuel Marcelo
(74) *Attorney, Agent, or Firm*—Fredrikson & Byron, P.A.

(57) ABSTRACT

An all terrain vehicle with a plurality of independent winches is provided. One winch may be mounted on the front of the all terrain vehicle. Another winch may be mounted at the rear of the all terrain vehicle. The winches are controlled independently of each other. For example, the front winch can be driven in a forward direction or a reverse direction independently of the rear winch, and the rear winch can be driven in a forward direction or a reverse direction independently of the front winch. Additionally, the front winch and the rear winch may be engaged to operate simultaneously.

29 Claims, 9 Drawing Sheets

ALL TERRAIN VEHICLE WITH MULTIPLE WINCHES

TECHNICAL FIELD

The present invention relates to an all terrain vehicle (ATV) with multiple winches, and, more particularly, to an ATV with two independent winches, one mounted in front and one mounted in the rear of the vehicle.

BACKGROUND OF THE INVENTION

All terrain vehicles (ATVs) are multipurpose vehicles that are popular for recreational use, such as camping and fishing, and utility use either on the job or around the house. The adaptability and versatility of an ATV can support many off-road tasks within agriculture, forestry, horticulture and similar outdoor industries. In addition, this adaptability and versatility make ATVs ideal for military use. ATVs easily traverse various off-highway trails, reach rugged locations that other vehicles cannot, and offer business operators the opportunity to accomplish work in the field at significant financial savings when compared to using a truck or tractor. Utility ATVs, especially suited for hauling and towing as well as trail riding, are as popular as ATVs for weekend recreational riding. ATVs operate in all climates and are among the most versatile vehicles in operation today.

ATVs are off-road vehicles characterized by having four wheels (two front and two rear) with low pressure tires, handlebars connected to the front wheels for steering, a straddle-type seat designed for a single rider (although the seat may be designed to accommodate multiple passengers), laterally extending footrests on opposite sides of the vehicle, and an engine and transmission located generally beneath the straddle-type seat and substantially between the footrests. ATVs are generally not wider than about 50 inches; most commonly about 44 to 48 inches in overall width. The transmission typically is connected by a suitable drive train to the rear wheels. In many applications, it is desirable to have all four wheels driven by the engine. Four wheel drive ATVs usually have one drive train connecting the transmission to the rear wheels and a separate drive train connecting the transmission to the front wheels.

ATVs are occasionally fitted with a winch. A winch is a stationary motor-driven or hand-powered machine used for pulling, hoisting, hauling or to assist in the extraction of the ATV from a stuck position. A typical winch has a cable made of wound metal strands, rope, chain, or other similar material having high tensile strength wound around a drum. In addition, the winch may have a hook at one end of the cable useful for attaching the cable to a desired object. The winch may also include opposed cylindrical rollers attached on each side of the cable to facilitate winding and unwinding. Motor-driven winches often have an operator control switch mounted on or near the handlebars. The motor is generally electric and is powered by the ATV's battery or electrical system.

The winch can be used in a variety of ways. For example, one end of the cable may be attached to a stationary object and the winch used to help move or extricate the ATV from an entangled position. Additionally, one end of the cable may be attached to an object in order to hoist or haul it.

ATVs occasionally have either a front or a rear mounted winch, but not both. Some ATVs have a transfer system that allows a single winch to be moved to a front mounting location or to a rear mounting location. In such transfer systems, power for the winch is supplied simultaneously to both the front and rear electrical harnesses. That is, if a second winch was added to the mounting location not occupied by the first winch, the winches would operate simultaneously unless the operator unplugged one of the winches from its electrical harness. For example, if the operator actuates the front winch, the rear winch would be actuated too.

The transfer design can render the winch useless in many situations. If an ATV becomes stuck, it is time consuming, inconvenient, or impossible to transfer the winch from one end of the ATV to the other. For instance, if one end of the ATV is submerged or butted up against an object, the winch at that end is not accessible. If the winch cannot be transferred to the appropriate position for a given situation it cannot be utilized for its intended use.

SUMMARY OF THE INVENTION

The present invention improves upon the winch transfer system by providing an all terrain vehicle with front and rear motor-driven winches that are independently operable. In one embodiment, an operator selector switch may be used to select which of the winches, front and/or rear, may be selected for operation.

DETAILED DESCRIPTION OF THE INVENTION

Figure 1:
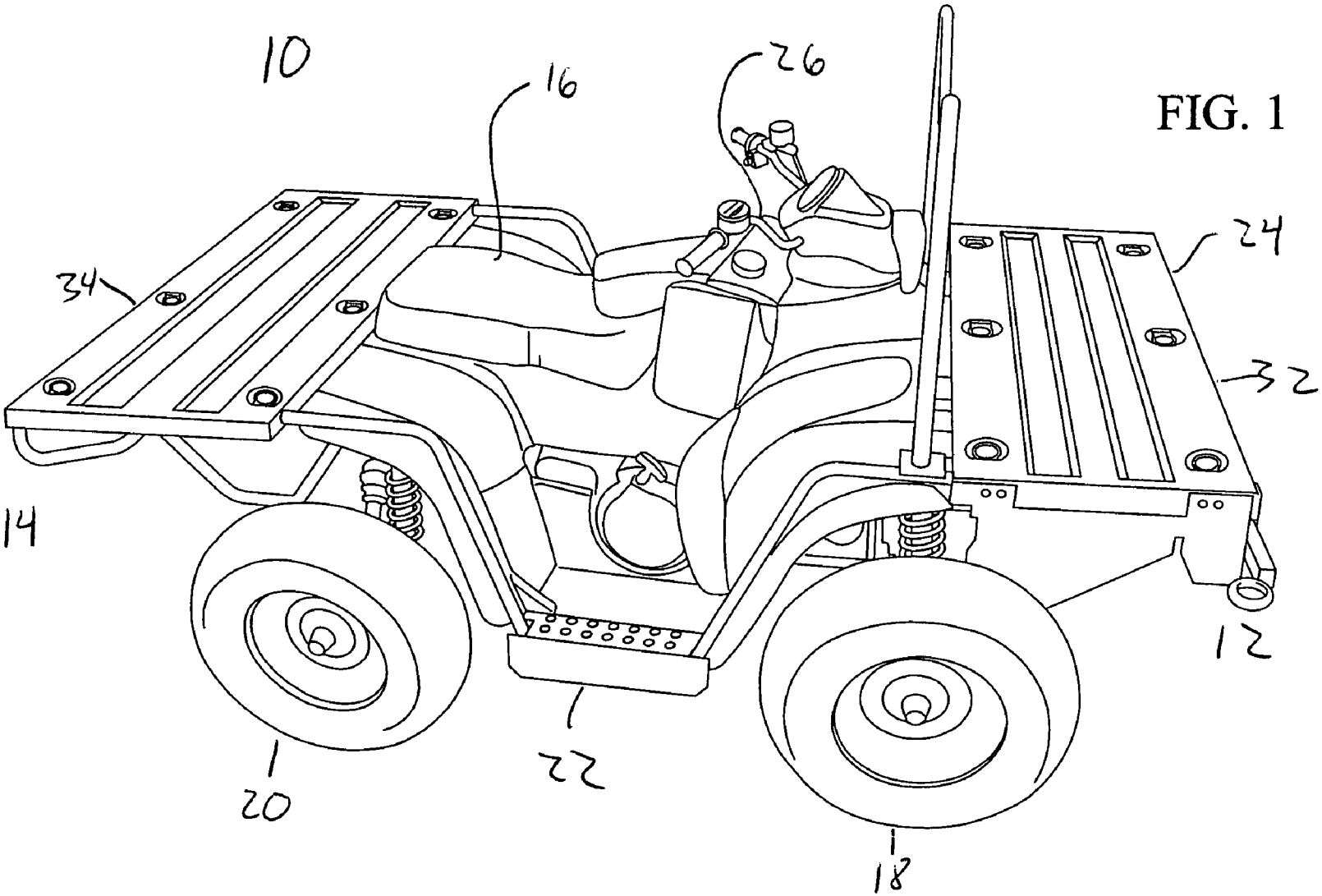
FIG. 1 is a side profile view of an ATV in an embodiment of the present invention.

As shown in FIG. 1, the present invention includes an ATV 10 having a front end 12 and a rear end 14. The ATV 10 comprises chassis carrying seat 16. In one embodiment, the seat 16 is sufficiently narrow to be straddled by a vehicle rider. ATV 10 also has a pair of front wheels 18 and a pair of rear wheels 20 and at least one laterally extending footrest 22. The ATV may also include a front support rack 24 attached to chassis or frame. ATV 10 also includes a steering member that may be used for steering ATV 10. In the embodiment shown in FIG. 1, the steering member comprises handlebars 26. ATV 10 also includes an engine that is carried by the chassis. The engine is preferably coupled to at least some of the front wheels 18 and/or rear wheels 20 of ATV 10 via a drive train for propelling ATV 10. The engine may be used to power each rear wheel, and in some cases also each front wheel.

Figure 2:
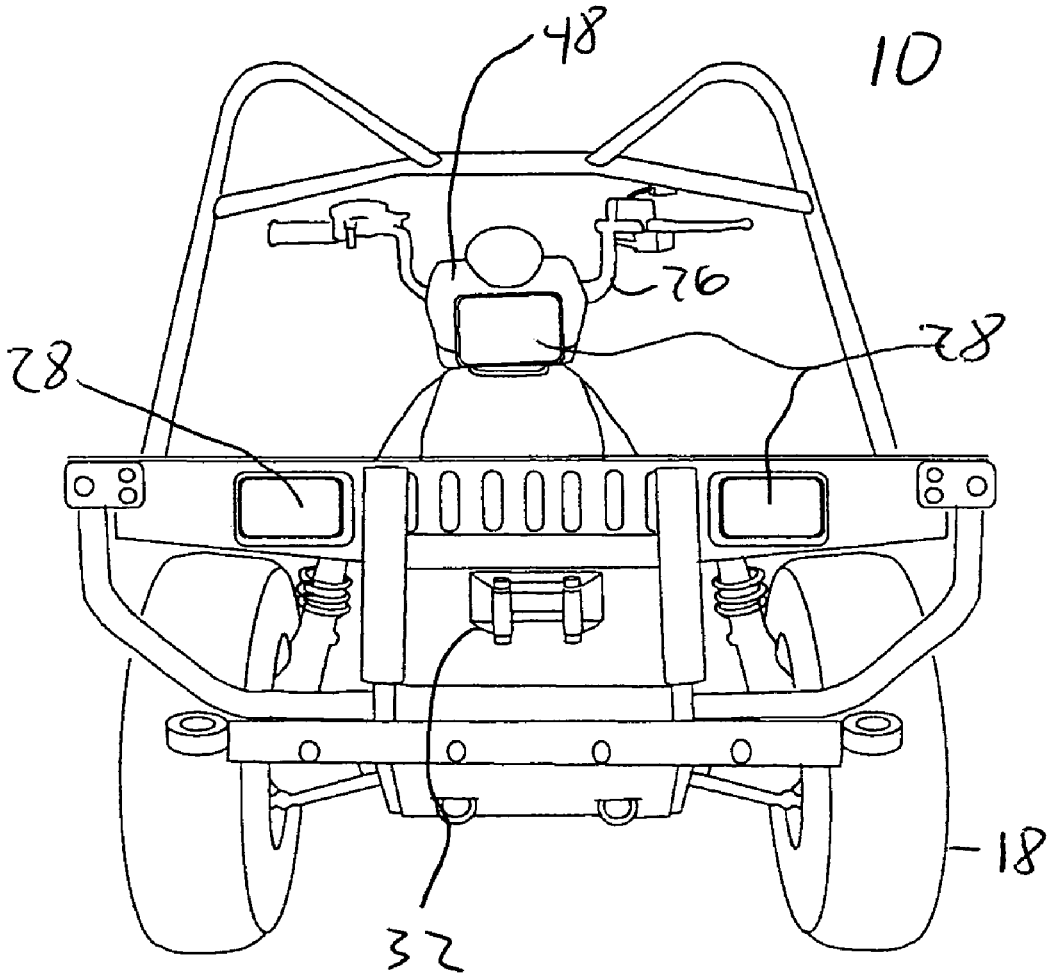
FIG. 2 is a front profile view of an ATV in an embodiment of the present invention.
Figure 3:
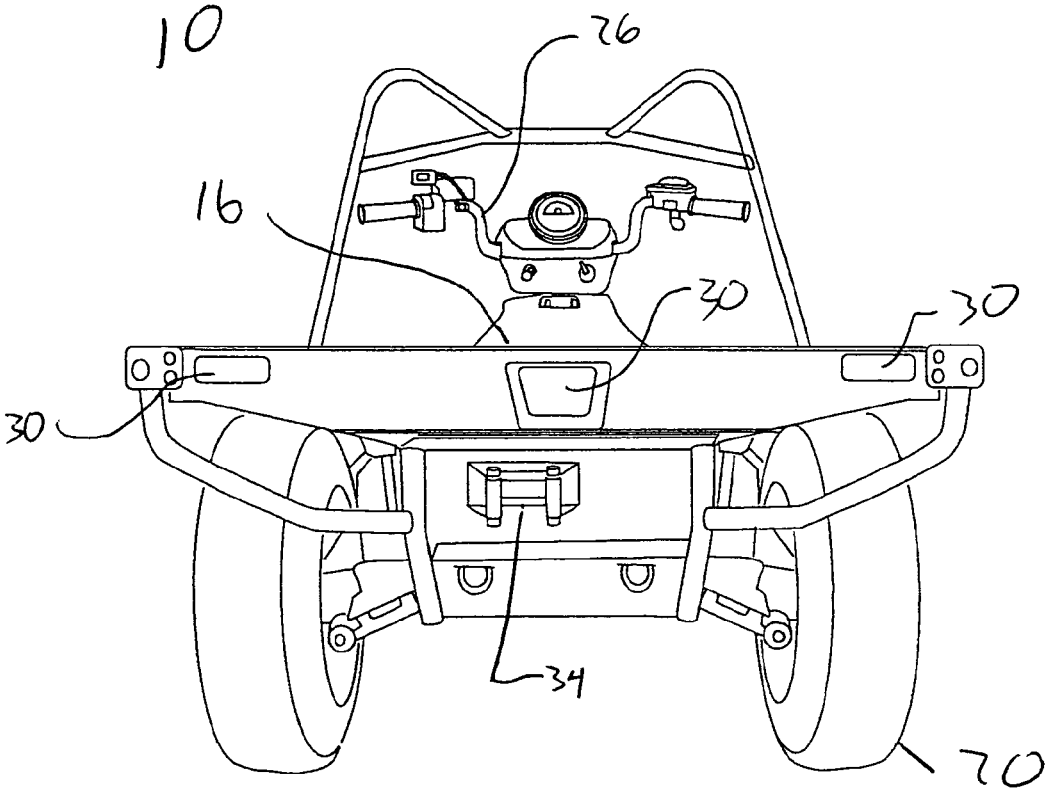
FIG. 3 is a rear profile view of an ATV in an embodiment of the present invention.

In some embodiments, ATV 10 includes means to generate electrical power to provide source power to a plurality of winches and other electrical components, such as headlights 28 and taillights 30 (see FIGS. 2 and 3). The power source may be an internal battery carried by the ATV 10, a generator connected to the engine, or another energy storage device. Preferably, the power source is DC, although AC may be used if an appropriate AC to DC converter were also employed. In another embodiment, the winches could be powered by an AC power source.

The ATV includes a plurality of winches. In one embodiment, the ATV 10 includes a front winch 32 as shown diagrammatically in FIG. 2, and a rear winch 34 as shown diagrammatically in FIG. 3. Front winch 32 and rear winch 34 are independently operable as explained below. Front winch 32 can be attached to ATV 10 in any location that allows a substantially rigid and sturdy connection between front winch 32 and ATV 10.

Figure 4:
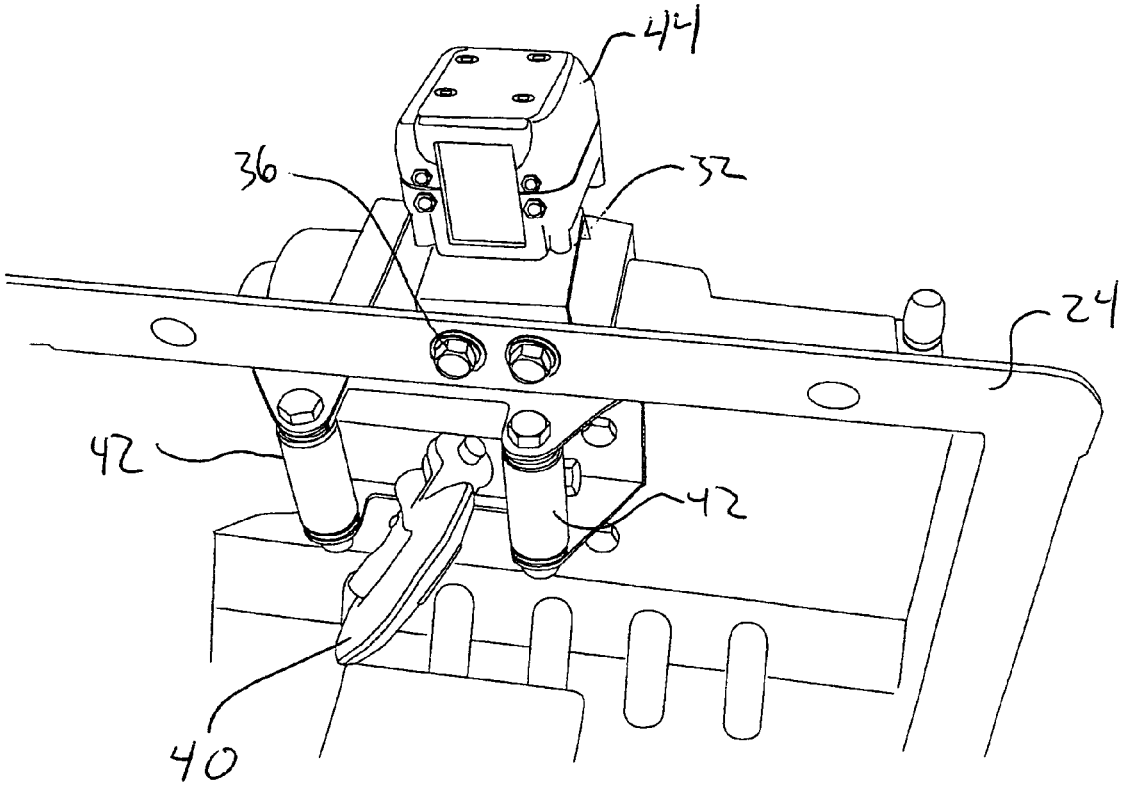
FIG. 4 is an elevated view of a winch attached to an ATV in an embodiment of the present invention.
Figure 5:
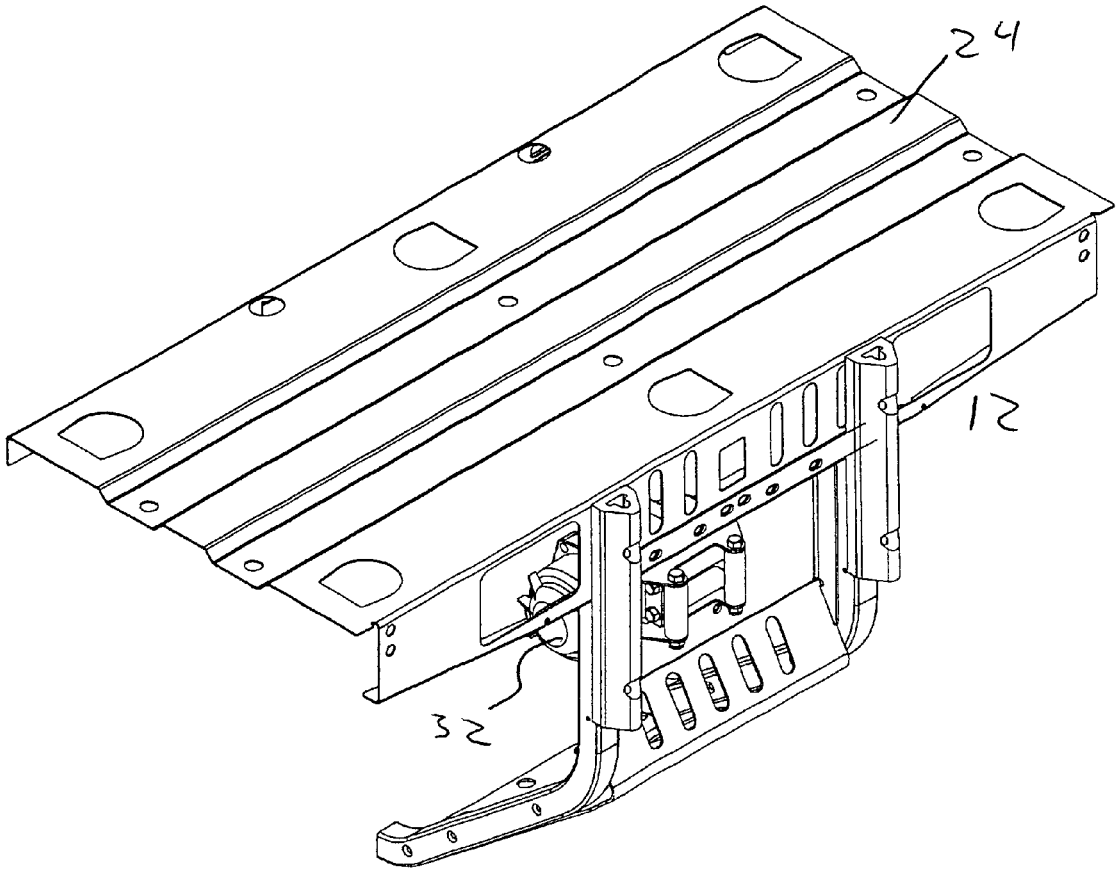
FIG. 5 is an elevated perspective view of a winch attached to an ATV in an embodiment of the present invention.

As shown in FIGS. 4 and 5, front winch 32 may be attached to support rack 24, which is in turn connected to a frame or chassis of the ATV. Front winch 32 can be attached by any means to form a rigid and sturdy connection to the ATV 10. For example, front winch 90 may be attached to ATV 10 with bolts or rivets 36 (as shown in FIG. 4).

Figure 6:
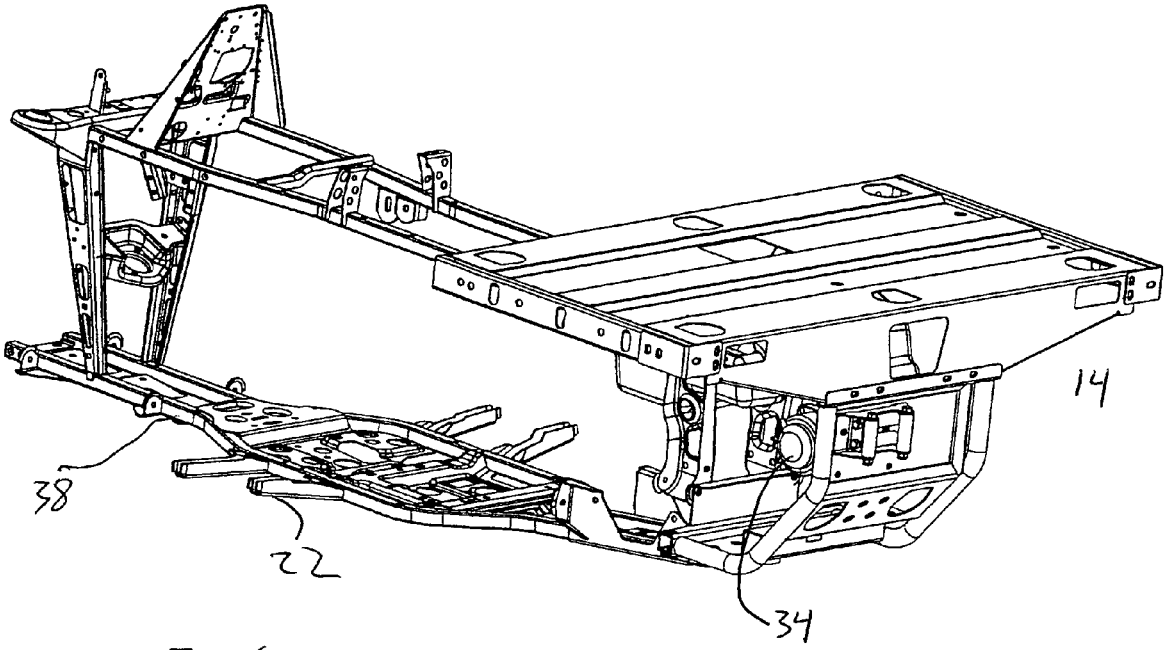
FIG. 6 is a side profile view of a winch attached to an ATV frame in an embodiment of the present invention.

Rear winch 34 can be attached to ATV 10 in any location that allows a substantially sturdy connection between rear winch 34 and ATV 10. As shown in FIG. 6, rear winch 34 may be attached to chassis 38. Rear winch 34 may be attached by any means to form a rigid connection. For example, rear winch 34 may be attached to ATV 10 with bolts or rivets.

Each winch is typically comprised of a cable wound about a drum connected to an electrical motor. As shown in FIG. 4, each winch may also include a hook 40 attached to the free end of the cable, and a plurality of rollers 42 useful for facilitating the winding and unwinding of the cable as driven by the winch's electrical motor 44.

Figure 7:
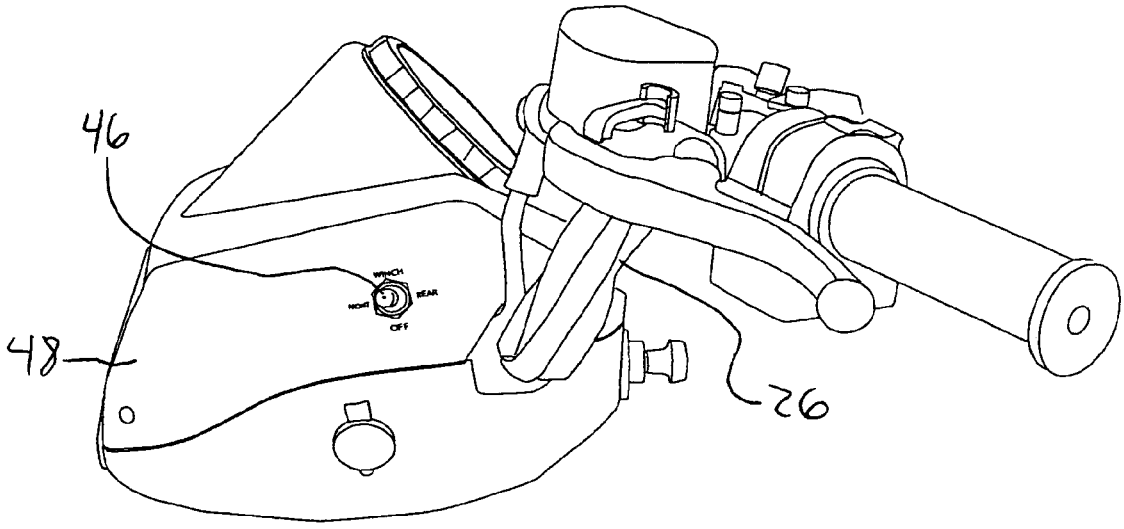
FIG. 7 is a side view of an operator selector switch attached to an ATV in an embodiment of the present invention.

Front winch 32 and rear winch 34 are independently operable. The operator can selectively control front winch 32 or rear winch 34 with operator selector switch 46. The operator selector switch 46 may be located anywhere on ATV 10. Referring to the embodiment shown in FIG. 7, the operator selector switch 46 is located on headlight housing 48. In this embodiment, the operator selector switch 46 is a three-position switch with positions labeled FRONT, REAR, and OFF. In the FRONT position, the front winch 32 only is selected for actuation. In the REAR position, the rear winch 34 only is selected for actuation. In the OFF position, neither winch 32, 34 is selected for actuation, such that neither winch operates.

In one alternate embodiment, the operator selector switch 46 includes a fourth position that selects both the front and rear winches 32, 34 for simultaneous operation. In another embodiment, the selector switch 46 may have only a first position to connect the power source to the front winch 32 and a second position to connect the power source to the rear winch 34.

Figure 8:
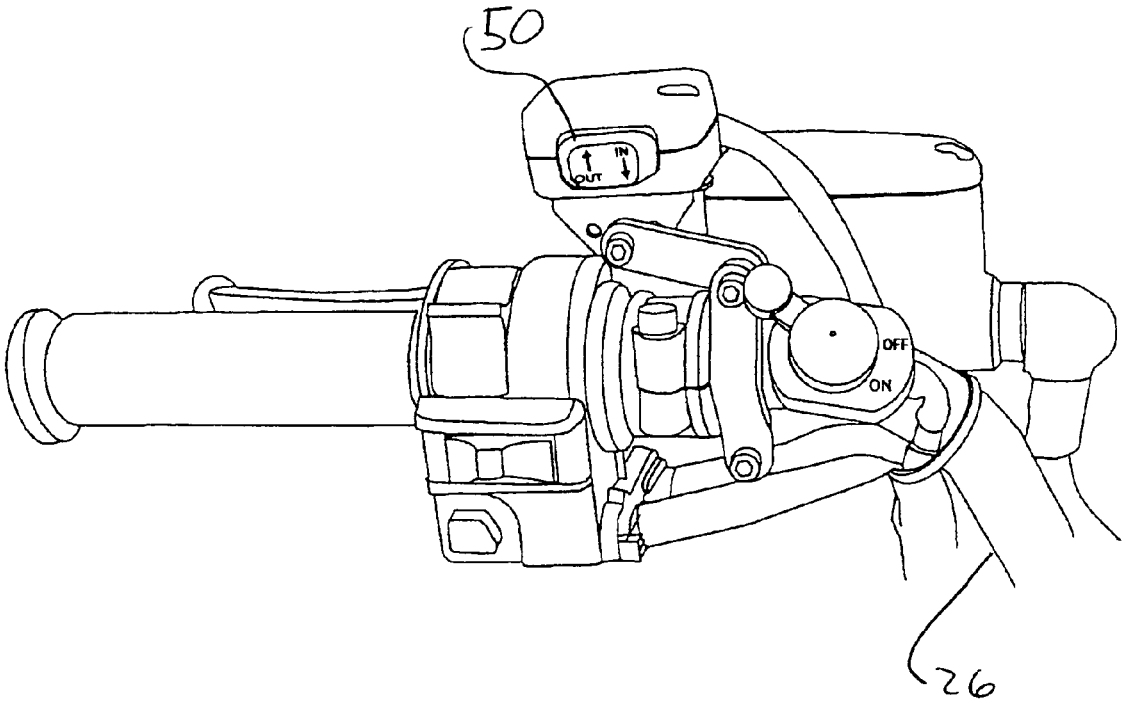
FIG. 8 is a perspective view of an operator control switch in an embodiment of the present invention.

The operator can control the direction, winding or unwinding, of the selected winch or winches with operator directional control switch 50. Control switch 50 may be mounted anywhere on the ATV 10. Referring to the embodiment shown in FIG. 8, operator control switch 50 is located on handlebar 26. In this embodiment, the operator control switch 50 is a manually operated three-position switch. As shown in FIG. 8, the three switch 50 positions are OUT, IN, and OFF. OUT is chosen by manually toggling the switch 50 leftward. IN is selected by manually toggling the switch 50 rightward. OFF, although not labeled, is chosen by allowing the position to rock back to center. The operator control switch 50 defaults to the off position. That is, the switch 50 is spring biased to return to the center, "off" position in the absence of any force toggling the switch 50 leftward or rightward.

Although control switch 50 is shown as a toggle switch in FIG. 8, it is understood that any functional equivalent directional control mechanism may be substituted that allows the operator to manually select at least IN, OUT, and OFF.

Figure 9:
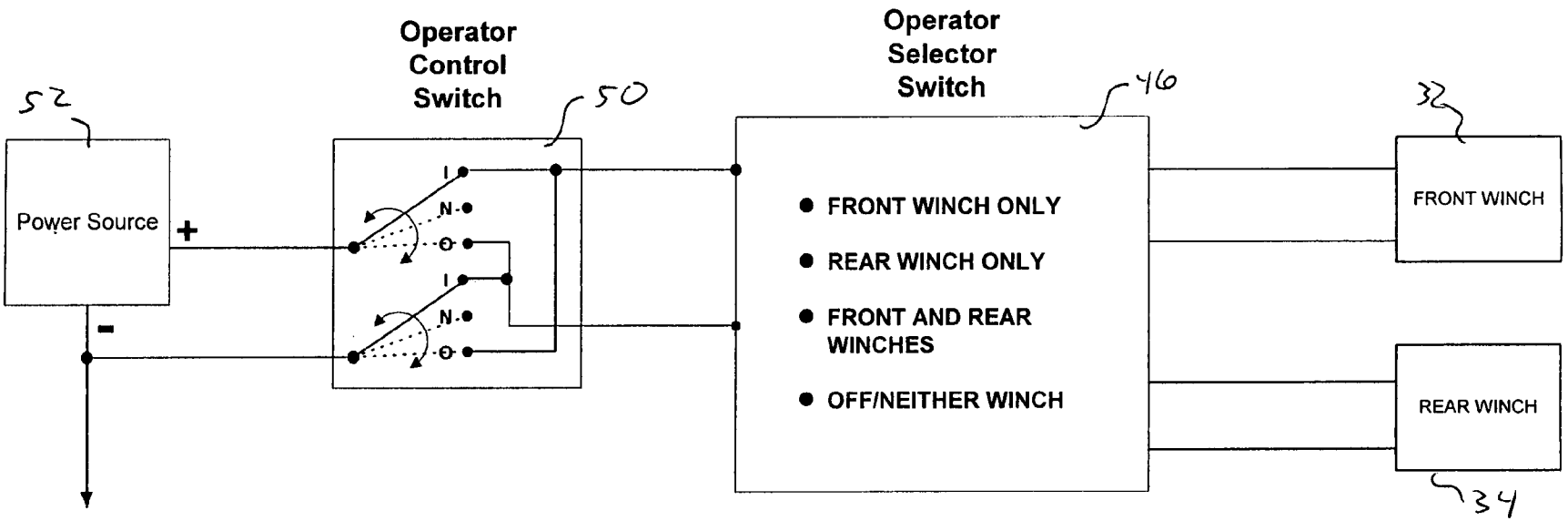
FIG. 9 is a schematic diagram showing an operator control switch and an operator selector switch in an embodiment of the present invention.

FIG. 9 is a schematic diagram of a preferred embodiment showing the electrical connections between the power source 52, operator control switch 50, operator selector switch 46, front winch 32 and rear winch 34. As shown in FIG. 9, the directional control switch 50 connects to the operator selector switch 46. The selector switch 46 allows the operator to select which winches 32, 34 (or others) are actuated in or out by the control switch 50.

In the preferred embodiment shown in FIG. 9, the operator selector switch 46 is a manually operable four-position switch. The operator selector switch 46 setting routes the electrical power to the desired winch or winches 32, 34. In this embodiment, the operator selector switch 46 includes a first position to connect the power source to the front winch 32 only, a second position to connect the power source to the rear winch 34 only, a third position to connect both the front winch 32 and the rear winch 34 to the power source, and a fourth position to prevent connection between the power source and both the front winch 32 and the rear winch 34.

The operator directional control switch 50 is shown diagrammatically in FIG. 9. As shown in FIG. 9, in the "off" position (shown as N or neutral in the diagram), the control switch 50 opens the connection between the power source and the operator selector switch 46. When manually toggled to the IN position (shown as I in the diagram), the operator control switch 50 connects the power source to the operator selector switch 46 with one voltage polarity, for example, positive. In this position, the selected winch or winches 32, 34 will wind. When manually toggled to the OUT position (shown as O in FIG. 8), the operator control switch 50 acts as a crossover switch and connects the power source to the operator selector switch 46 with the opposite polarity. In this position, the selected winch or winches 32, 34 will unwind themselves.

In an alternate embodiment, the operator selector switch 46 and operator control switch 50 may be combined into a single multiposition switch. This multiposition switch could include positions such as front-in, front-out, rear-in, and rear-out. For example, the mulitposition switch could include a front-in position for directing power to the front winch 32 of the proper polarity to wind front winch 32.

As another alternative embodiment, the power source may be connected to the operator selector switch 46. The operator selector switch 46 would route the signal to one or more operator control switches 50 capable of independently winding or unwinding both front winch 32 and/or rear winch 34.

It is noted that an ATV is merely an example vehicle for which the present invention may be used. Although the present invention is shown and described in the context of an ATV, the present invention can also be employed for other utility and recreation vehicles, e.g. snowmobiles, in a manner that would be apparent to those of ordinary skill in the art.

What is claimed is:

1. An all terrain vehicle comprising:

a chassis carrying a straddle-type seat;

a pair of front wheels mounted to the chassis, and a steering mechanism operatively connected to the front wheels for steering the vehicle;

a pair of rear wheels mounted to the chassis;

an engine carried by the chassis, the engine being connected to a drive train supplying motive power to at least some of the wheels;

a front winch located proximate the front of the all terrain vehicle; and a rear winch located proximate the rear of the all terrain vehicle, the front and rear winches being independently operable.

2. The all terrain vehicle of claim 1, further comprising a selector switch that selects which of the front winch and rear winch is operable.

3. The all terrain vehicle of claim 2, wherein the selector switch is electrically connected between the control switch and the winches.

4. The all terrain vehicle of claim 2, wherein the selector switch includes a first position to select the front winch only, a second position to select the rear winch only, a third position to select both the front winch and the rear winch, and a fourth position to select neither the front winch nor the rear winch.

5. The all terrain vehicle of claim 2, wherein the selector switch includes at least one position to select the front winch and not the rear winch and a second position to select the rear winch and not the front winch.

6. The all terrain vehicle of claim 2, wherein the selector switch is manually operated.

7. The all terrain vehicle of claim 1, further including a control switch that actuates the selected winches in the in or out directions.

8. The all terrain vehicle of claim 7, wherein the control switch has in and out positions that actuate the selected winches in the wind and unwind directions respectively.

9. The all terrain vehicle of claim 8, wherein the in position connects the vehicle power source to the selected winches at one voltage polarity and the out position connects the power source to the selected winches at an opposite voltage polarity.

10. The all terrain vehicle of claim 8, wherein the in direction corresponds to winding the winch and the out direction corresponds to unwinding the winch.

11. The all terrain vehicle of claim 7, wherein the control switch is manually operated.

12. The all terrain vehicle of claim 7, wherein the control switch has an in position, an out position, and an off position.

13. The all terrain vehicle of claim 1, further including a control switch that connects a vehicle power source to the selected winches.

14. An all terrain vehicle comprising:

a chassis having a straddle-type seat;

a pair of front wheels mounted to the chassis, and a steering mechanism operatively connected to the front wheels for steering the vehicle;

a pair of rear wheels mounted to the chassis;

an engine carried by the chassis, the engine being connected to a drive train supplying motive power to at least some of the wheels;

a front motor driven winch rigidly attached towards the front of the all terrain vehicle;

a rear motor driven winch rigidly attached towards the rear of the all terrain vehicle;

a vehicle power source for supplying power to the winches; and a selector switch that selects which of the front winch and rear winch is operable.

15. The all terrain vehicle of claim 14, further including a control switch that actuates the selected winches in the in or out directions.

16. The all terrain vehicle of claim 15, wherein the control switch has in and out positions that actuate the selected winches in the wind and unwind directions respectively.

17. The all terrain vehicle of claim 16, wherein the in position connects the vehicle power source to the selected winches at one voltage polarity and the out position connects the power source to the selected winches at an opposite voltage polarity.

18. The all terrain vehicle of claim 16, wherein the in direction corresponds to winding the winch and the out direction corresponds to unwinding the winch.

19. The all terrain vehicle of claim 15, wherein the control switch is manually operated.

20. The all terrain vehicle of claim 15, wherein the control switch and the selector switch are separate switches.

21. The all terrain vehicle of claim 15, wherein the control switch has an in position, an out position, and an off position.

22. The all terrain vehicle of claim 14, further including a control switch that connects the vehicle power source to the selected winches.

23. The all terrain vehicle of claim 14, wherein the selector switch is electrically connected between the control switch and the winches.

24. The all terrain vehicle of claim 14, wherein the selector switch includes a first position to select the front winch only, a second position to select the rear winch only, a third position to select both the front winch and the rear winch, and a fourth position to select neither the front winch nor the rear winch.

25. The all terrain vehicle of claim 14, wherein the selector switch includes at least one position to select the front winch and not the rear winch and a second position to select the rear winch and not the front winch.

26. The all terrain vehicle of claim 14, wherein the selector switch is manually operated.

27. An all terrain vehicle comprising:

a chassis carrying a straddle-type seat which is sufficiently narrow to be straddled by a rider;

a pair of front wheels operatively mounted to the chassis, and handlebars operatively connected to the front wheels for steering the vehicle;

a pair of rear wheels operatively mounted to the chassis;

an engine carried by the chassis, the engine being connected to a drive train supplying motive power to at least some of the wheels; and a plurality of winches, the winches being attached to the all terrain vehicle in locations suitable for pulling the all terrain vehicle in substantially opposite directions.

28. The all terrain vehicle of claim 27, wherein one of the plurality of winches is rigidly attached towards the front of the all terrain vehicle.

29. The all terrain vehicle of claim 27, wherein one of the plurality of winches is rigidly attached towards the rear of the all terrain vehicle.

* * * * *